US011052689B2

(12) United States Patent
Asawa

(10) Patent No.: US 11,052,689 B2
(45) Date of Patent: Jul. 6, 2021

(54) PRINTING APPARATUS

(71) Applicant: SEIKO EPSON CORPORATION, Tokyo (JP)

(72) Inventor: Hiroshi Asawa, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/791,206

(22) Filed: Feb. 14, 2020

(65) Prior Publication Data

US 2020/0262223 A1 Aug. 20, 2020

(30) Foreign Application Priority Data

Feb. 15, 2019 (JP) ..... JP2019-025248

(51) Int. Cl.
*B41J 29/377* (2006.01)
*B41J 11/00* (2006.01)

(52) U.S. Cl.
CPC ..... *B41J 29/377* (2013.01); *B41J 11/002* (2013.01)

(58) Field of Classification Search
CPC . B41J 29/377; B41F 3/52; B41F 13/22; B41F 23/04; B41F 23/0476; B41F 23/0483; B41F 31/002
See application file for complete search history.

(56) References Cited

U.S. PATENT DOCUMENTS

2013/0127962 A1 5/2013 Yoda
2014/0267521 A1* 9/2014 Suzuki ..... B41J 11/04 347/102

FOREIGN PATENT DOCUMENTS

| | | |
|---|---|---|
| JP | 2013-107275 | 6/2013 |
| JP | 2013-226698 | 11/2013 |
| JP | 2014-181083 | 9/2014 |
| JP | 2018-158514 | 10/2018 |

* cited by examiner

*Primary Examiner* — Julian D Huffman
(74) *Attorney, Agent, or Firm* — Workman Nydegger

(57) ABSTRACT

A printing apparatus includes a rotary drum that is provided with a cylindrical body, a rotary shaft, and arm portions, an ejecting unit, a first cooling fan that uses a section formed in the circumferential direction between the arm portions as a passageway of air and that supplies the air, and a first air guide member that is retrofitted to the passageway of the air. The first air guide member is provided with a number a of first guides, a being an integer of 2 or more. The number a of the first guides are configured to guide the air from the first cooling fan to regions that are different positions of the inner surface of the cylindrical body and that are obtained by dividing up the inner surface of the cylindrical body by the number a in the direction along the rotary shaft.

5 Claims, 10 Drawing Sheets

PRINTING APPARATUS

The present application is based on, and claims priority from JP Application Serial Number 2019-025248, filed Feb. 15, 2019, the disclosure of which is hereby incorporated by reference herein in its entirety.

BACKGROUND

1. Technical Field

The present disclosure relates to a printing apparatus including a rotary drum.

2. Related Art

Documents of related art regarding this type of printing apparatus provided with a rotary drum include JP-A-2018-158514. In JP-A-2018-158514, with regard to a center drum-type inkjet recording device using UV ink, a structure is disclosed that causes cooling air to be blown against an inner circumferential surface of a platen drum in order to improve the efficiency of cooling the platen drum supporting a recording medium, the cooling air being supplied in an axial direction of the platen drum toward the inner circumference of the platen drum using a cooling fan. Specifically, it is described that an air guide member is formed inside the drum to cause the cooling air to be guided to the inner circumferential surface of the drum.

However, the air guide member described in JP-A-2018-158514 does not provide a sufficient configuration for improving the cooling effect of the drum.

Further, the way in which the air guide member is provided inside the drum is not described, and it appears from the drawings that the air guide member is integrally formed with the drum. If the air guide member is integrally formed with the drum, a degree of difficulty in forming a casting mold of the drum increases, and at the same time, the cost becomes higher. Further, the weight of the drum itself becomes heavier, which makes handling of the drum more difficult.

SUMMARY

The present disclosure for solving the above-described problems is a printing apparatus including a rotary drum including a cylindrical body, a rotary shaft, and a plurality of arm portions that couple an inner surface of the cylindrical body with the rotary shaft and are provided at an interval in a circumferential direction of the cylindrical body, an ejecting unit configured to eject liquid to perform printing on a recording medium that is transported while being wound around the cylindrical body of the rotary drum, a first cooling fan configured to supply air into a passageway of the air in a direction along the rotary shaft, the passageway of the air being a section inside the rotary drum corresponding to the interval between the plurality of arm portions, and a first air guide member retrofitted to the passageway of the air between the plurality of arm portions. The first air guide member is provided with a number a of first guides, a being an integer of no less than 2, and the number a of the first guides guide the air from the first cooling fan to different positions on the inner surface of the cylindrical body, the different positions being, when the inner surface of the cylindrical body is divided into the number a of regions in the direction along the rotary shaft, each of the number a of the divided regions.

DESCRIPTION OF EXEMPLARY EMBODIMENTS

Figure 1:
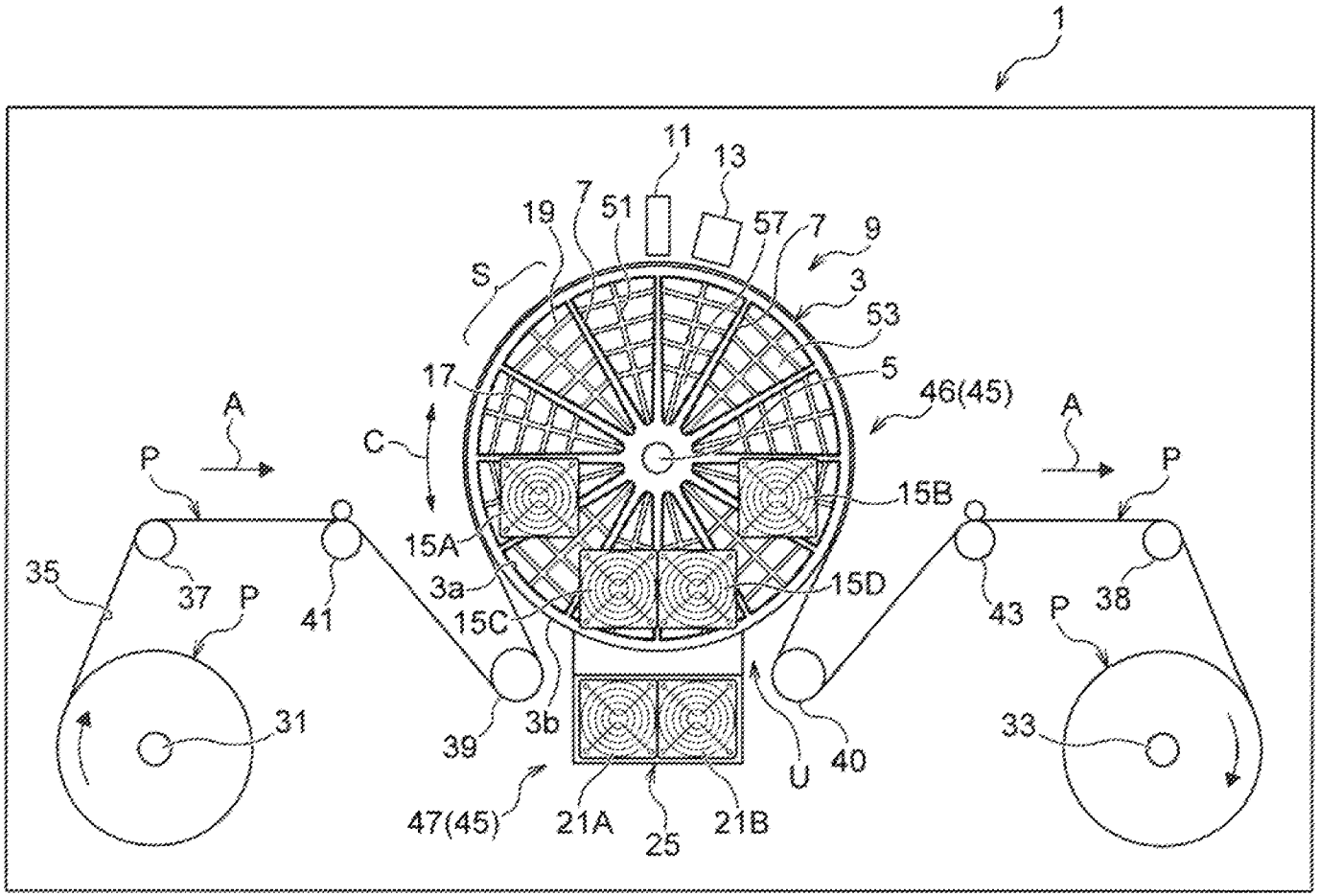
FIG. 1 is a front perspective view schematically illustrating an outline of an overall configuration of a printing apparatus according to an embodiment of the present disclosure.
Figure 2:
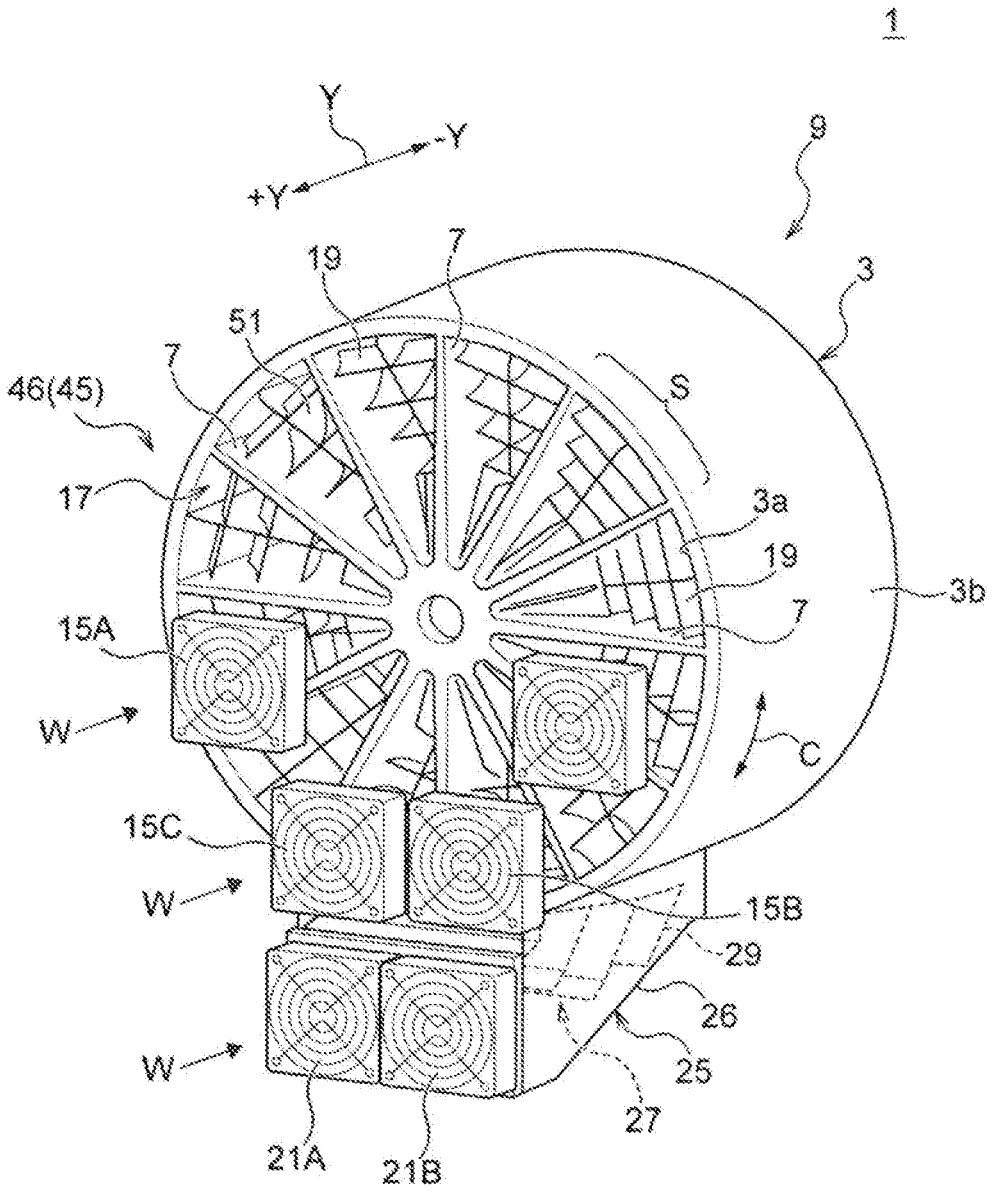
FIG. 2 is a perspective view illustrating a rotary drum, a first cooling unit, and a second cooling unit according to the embodiment of the present disclosure.
Figure 3:
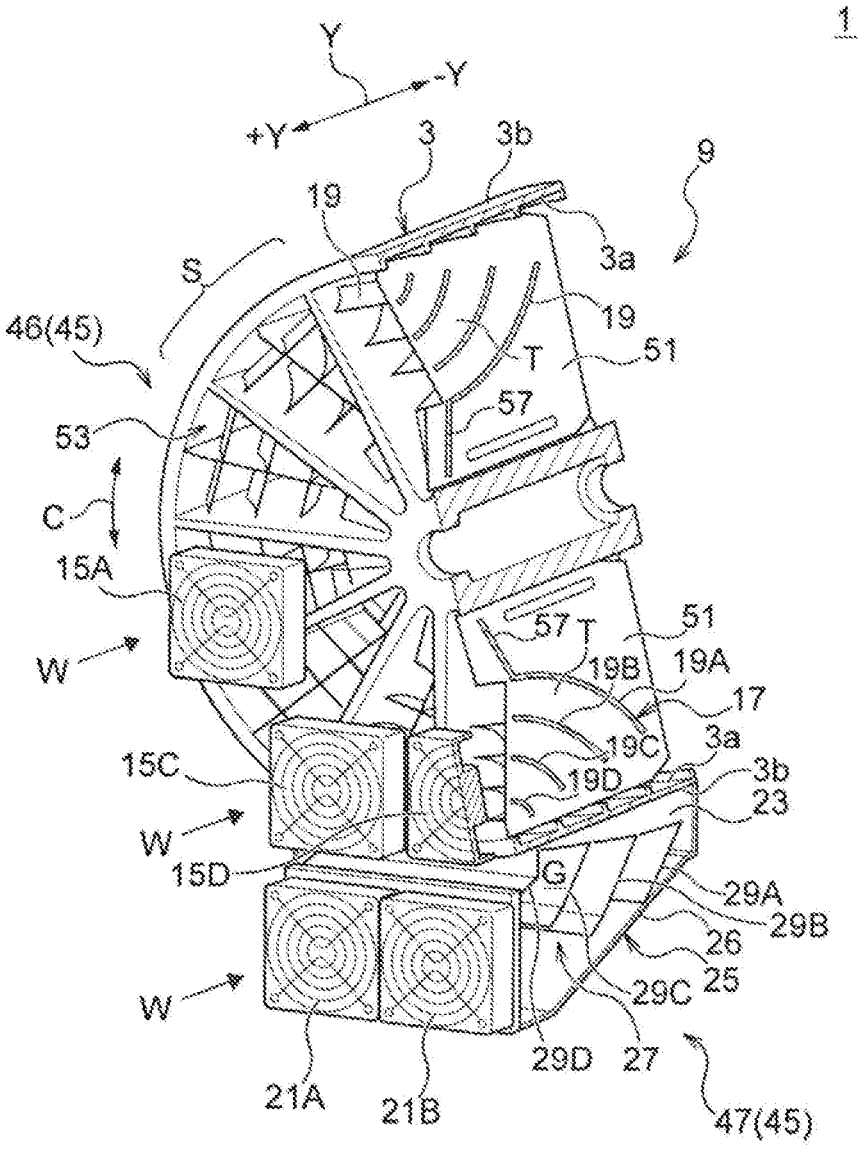
FIG. 3 is a partially broken perspective view illustrating the rotary drum, the first cooling unit, and the second cooling unit according to the embodiment of the present disclosure.

First, the present disclosure will be schematically described.

A printing apparatus of a first aspect of the present disclosure for solving the above-described problems includes a rotary drum including a cylindrical body, a rotary shaft, and a plurality of arm portions that couple an inner surface of the cylindrical body with the rotary shaft and are provided at an interval in a circumferential direction of the cylindrical body, an ejecting unit configured to eject liquid to perform printing on a recording medium that is transported while being wound around the cylindrical body of the rotary drum, a first cooling fan configured to supply air into a passageway of the air in a direction along the rotary shaft, the passageway of the air being a section inside the rotary drum corresponding to the interval between the plurality of arm portions, and a first air guide member retrofitted to the passageway of the air between the plurality of arm portions. The first air guide member is provided with a number a of first guides, a being an integer of no less than 2, and the number a of the first guides guide the air from the first cooling fan to different positions on the inner surface of the cylindrical body, the different positions being, when the inner surface of the cylindrical body is divided into the number a of regions in the direction along the rotary shaft, each of the number a of the divided regions.

Here, "retrofitted" in the "first air guide member retrofitted" means that the first air guide member is manufactured separately from the cylindrical body, the rotary shaft, and the arm portions that configure the rotary drum, and is then attached thereto.

According to this aspect, the first air guide member is provided with the number a of the first guides, a being an integer of 2 or more, and the number a of the first guides guide the air from the first cooling fan to the different positions on the inner surface of the cylindrical body. When the inner surface of the cylindrical body is divided into the number a of regions in the direction along the rotary shaft, the different positions are each of the number a of the divided regions. As a result, since the air is guided to and blown against each of the number a of the regions on the inner surface of the cylindrical body, the rotary drum can be effectively cooled.

Further, since the first air guide member is retrofitted to the passageway of the air between the arm portions, the first air guide member is manufactured and assembled separately from the rotary drum. As a result, the manufacturing becomes easy, and also, a lighter material than that of the rotary drum can be selected for the first air guide member, which makes it easier to promote weight reduction.

According to the printing apparatus of a second aspect of the present disclosure, with respect to the first aspect, a unit volume weight of a material of the first air guide member is lighter than a unit volume weight of a material of the rotary drum.

According to this aspect, the unit volume weight of the material of the first air guide member is lighter than the unit volume weight of the material of the rotary drum, which makes it easier to promote weight reduction of the rotary drum.

According to the printing apparatus of a third aspect of the present disclosure, with respect to the first aspect or the second aspect, a plurality of ribs formed in the circumferential direction are provided at the inner surface of the cylindrical body. The plurality of ribs are disposed at an interval in the direction along the rotary shaft, and the different positions to which the air is guided by the number a of the first guides are positions that guide the air toward the inner surface of the cylindrical body, the air being supplied from the first cooling fan and blown against and caused to flow up by the plurality of ribs.

The plurality of ribs may be provided in the circumferential direction on the inner surface of the cylindrical body for reasons such as reinforcement, and the like. In this case, since the air supplied from the first cooling fan is blown against and caused to flow up by the ribs, the cooling air moves away from the inner surface of the cylindrical body.

According to this aspect, the number a of the first guides guide the air toward the inner surface of the cylindrical body, the air being supplied from the first cooling fan and blown against and caused to flow up by the ribs. As a result, since the air caused to flow up by the ribs can be blown against the inner surface of the cylindrical body again, the cooling effect can be improved.

According to the printing apparatus of a fourth aspect of the present disclosure, with respect to any one of the first aspect to the third aspect, the first air guide member is provided with a base plate and the number a of the first guides disposed on the base plate, and the number a of the first guides are disposed in a plane-symmetrical manner on both sides of the base plate.

According to this aspect, since the number a of the first guides are disposed in the plane-symmetrical manner on both the sides of the base plate, the first air guide member including the number a of the first guides can be easily manufactured. Further, by using the plane-symmetrical first guides, the cooling operation can be performed in a well-balanced manner.

According to a fifth aspect of the present disclosure, with respect to any one of the first aspect to the fourth aspect, the printing apparatus further includes a second cooling fan configured to supply the air along an outer surface of the cylindrical body in the direction along the rotary shaft, an air box configured to receive the air supplied from the second cooling fan and provided with an air outlet through which the air is blown toward the outer surface of the cylindrical body, and a second air guide member provided in the air box. The second air guide member is provided with a number b of second guides, b being an integer of no less than 3, and the number b of the second guides guide the air from the second cooling fan to different positions of the air outlet, the different positions being, when the outer surface of the cylindrical body is divided into a number b−1 of regions in the direction along the rotary shaft, each of the number b−1 of the divided regions.

According to this aspect, the rotary drum can be effectively cooled by the second air guide member using a mechanism substantially similar to that of the first air guide member.

Next, configurations and effects of embodiments of the present disclosure will be described below in detail with reference to the accompanying drawings.

Note that, in the following description, first, an outline of an overall configuration of a printing apparatus according to an embodiment will be described based on FIG. 1. Next, specific configurations of main portions of the present disclosure will be described based on FIG. 2 to FIG. 7, and reference will be made to a configuration of a modified example of a rotary drum of the present disclosure based on FIG. 8.

Further, based on FIG. 9 and FIG. 10, test results obtained by comparing a flow of cooling air when a cooling unit of a rotary drum of related art is employed with the flow of the cooling air when a first cooling unit and a second cooling unit according to the embodiment of the present disclosure are employed will be described, and reference will be made to the effects of the printing apparatus according to the embodiment of the present disclosure.

Finally, other embodiments of the printing apparatus of the present disclosure, each of which has a partially different configuration from that of the above-described embodiment will be briefly described.

Embodiments (1) Outline of Overall Configuration of Printing Apparatus (See FIG. 1)

A printing apparatus 1 of the present disclosure includes a rotary drum 9 provided with a cylindrical body 3, a rotary shaft 5, and a plurality of arm portions 7 that couple an inner surface 3*a* of the cylindrical body 3 and the rotary shaft 5 and are provided at an interval in a circumferential direction C, an ejecting unit that ejects liquid onto a recording medium P, which is transported while being wound around the cylindrical body 3 of the rotary drum 9, to perform printing, a first cooling fan 15 that supplies air W, in a direction Y along the rotary shaft 5, to passageways 53 of the air W, the passageways 53 being positioned inside the rotary drum 9 and between the arm portions 7, and first air guide members 17 that are retrofitted to the passageways 53 of the air W positioned between the arm portions 7.

Then, the first air guide member 17 is provided with a number a of first guides 19, a being an integer of 2 or more, and the number a of the first guides 19 guide the air W from the first cooling fan 15 to different positions on the inner surface 3*a* of the cylindrical body 3. When the inner surface 3*a* of the cylindrical body 3 is divided into the number a of regions Q in the direction Y along the rotary shaft 5, the different positions are configured to be each of the number a of the divided regions Q.

In addition, the printing apparatus 1 according to the embodiment illustrated in the drawings further includes a second cooling fan 21 that supplies the air W, in the direction Y along the rotary shaft 5, along an outer surface 3*b* of the cylindrical body 3, an air box 25 that receives the air W supplied from the second cooling fan 21 and blows the air W toward the outer surface 3*b* of the cylindrical body 3 and that is provided with an air outlet 23, and a second air guide member 27 provided in the air box 25.

Then, the second air guide member 27 includes a number b of second guides 29, b being an integer of 3 or more, and the number b of the second guides 29 guide the air W from the second cooling fan 21 to different positions of the air outlet 23. When the outer surface 3*b* of the cylindrical body 3 is divided into a number b−1 of regions R in the direction Y along the rotary shaft 5, the different positions are configured to be each of the number b−1 of the divided regions R.

Specifically, the printing apparatus 1 illustrated in FIG. 1 includes a feeding shaft 31 positioned upstream in a transport direction A, and causes the recording medium P fed out from the roll-type recording medium P attached to the feeding shaft 31 to be wound around the rotary drum 9 at a predetermined winding angle. Further, after ejecting each of colors of UV ink, which is an example of the liquid, from an ejecting head 11, which is a part of the ejecting unit, onto the recording medium P wound around the outer surface 3*b* of the cylindrical body 3 of the rotary drum 9, the printing apparatus 1 irradiates UV light from a UV irradiator 13, which is an example of a curing unit, and cures the UV ink ejected onto a front surface of the recording medium P.

Then, once the UV ink is ejected onto the front surface of the recording medium P and the UV ink is cured thereon, the recording medium P is taken up by a winding shaft 33 positioned downstream in the transport direction A. Hereinafter, while the recording medium P is continuously transported using a roll-to-roll transport method, a desired image is printed on the recording medium P by the UV ink ejected from the ejecting head 11.

Further, for example, guide rollers 37 and 38 and winding rollers 39 and 40 configured by driven rollers, and a transport roller 41 and a discharge roller 43 configured by a pair of nip rollers, which are configured by a driving roller and a driven roller, are disposed along a transport path 35 of the recording medium P.

Further, in this embodiment, as an example of sections extending from the rotary shaft 5 in the radial direction, a donut-shaped space formed between the inner surface 3*a* of the cylindrical body 3 and the rotary shaft 5 is divided into 12 sections in the circumferential direction C by the 12 arm portions 7, thereby forming fan-shaped sections in a front view, which form the passageways 53 of the cooling air W.

Then, in this embodiment, four of the first cooling fans 15 are provided, for example, and positions of those four first cooling fans 15A, 15B, 15C, and 15D provided are positions facing open surfaces of the fan-shaped sections. Of the four, the first cooling fans 15A and 15B are disposed closer to the inner circumference, for example, and the remaining first cooling fans 15C and 15D are disposed closer to the outer circumference, for example.

Further, in this embodiment, two of the second cooling fans 21 are provided in parallel, for example, and positions of those two second cooling fans 21A and 21B provided are set at positions facing an open surface provided in a front face for introducing the cooling air W, as an example of the air box 25. Note that, for example, the first cooling fans 15A, 15B, 15C, and 15D are disposed in an area below a horizontal plane passing through the rotary shaft 5 of the rotary drum 9, and the second cooling fans 21A and 21B are disposed in an non-winding area U in which the recording medium P is not wound on the rotary drum 9.

(2) Specific Configuration of Main Portions of Printing Apparatus (See FIG. 2 to FIG. 8)

Next, a cooling unit 45 of the rotary drum 9, which is a main portion of the printing apparatus 1 according to this embodiment, and which is applied to the rotary drum 9 of this type of printing apparatus 1, will be specifically described.

The cooling unit 45 of the rotary drum 9 includes a first cooling unit 46 that blows the cooling air W toward the inner surface 3*a* of the cylindrical body 3 of the rotary drum 9 to cool the rotary drum 9, and a second cooling unit 47 that blows the cooling air W toward the outer surface 3*b* of the cylindrical body 3 of the rotary drum 9 to cool the rotary drum 9.

(A) Specific Configuration of First Cooling Unit (See FIG. 2 to FIG. 4, and FIG. 7)

The first cooling unit 46 includes the first cooling fans 15 and the first air guide members 17 housed in the above-described fan-shaped sections, in a front view, of the rotary drum 9.

The rotary drum 9 is made of aluminum die cast, for example, and as the material of the first air guide member 17, a material whose unit volume weight is lighter than that of aluminum, which is the material of the rotary drum 9, is used. This material is specifically a polyethylene foam and the like, such as P•E Light RL-150FR made by Inoac Corporation. Incidentally, when such a light material is used as the material of the first air guide member 17, a moment of inertia at the time of rotating the rotary drum 9 is reduced to improve the rotational stability of the rotary drum 9, and further, it is possible to shorten a rotation startup time and a rotation stopping time, which are provided to allow the rotation speed of the rotary drum 9 to reach a set rotation speed at the time of starting and ending printing. As a result, an overall printing time can be shortened.

Figure 7:
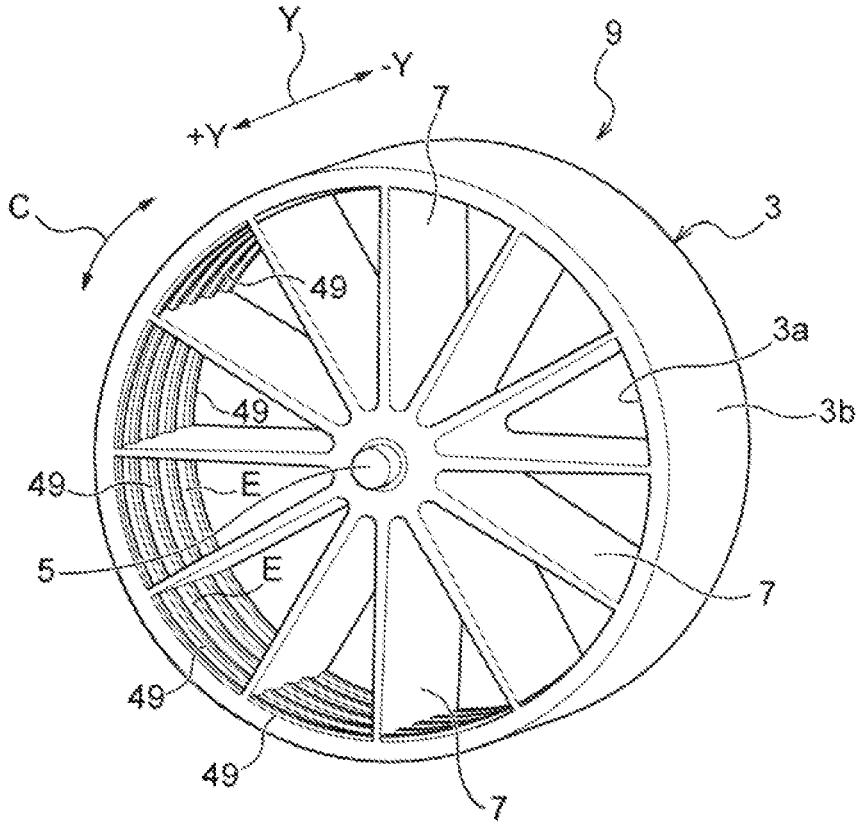
FIG. 7 is a perspective view illustrating the rotary drum according to the embodiment of the present disclosure.

Further, in this embodiment, as illustrated in FIG. 7, a plurality of ribs 49 are provided at the inner surface 3*a* of the cylindrical body 3 of the rotary drum 9 in order to reinforce the rotary drum 9 in the circumferential direction C. For example, including the ribs 49 on both ends, a total of five of the plurality of ribs 49 are disposed with an interval E therebetween in the direction Y along the rotary shaft 5.

Figure 4:
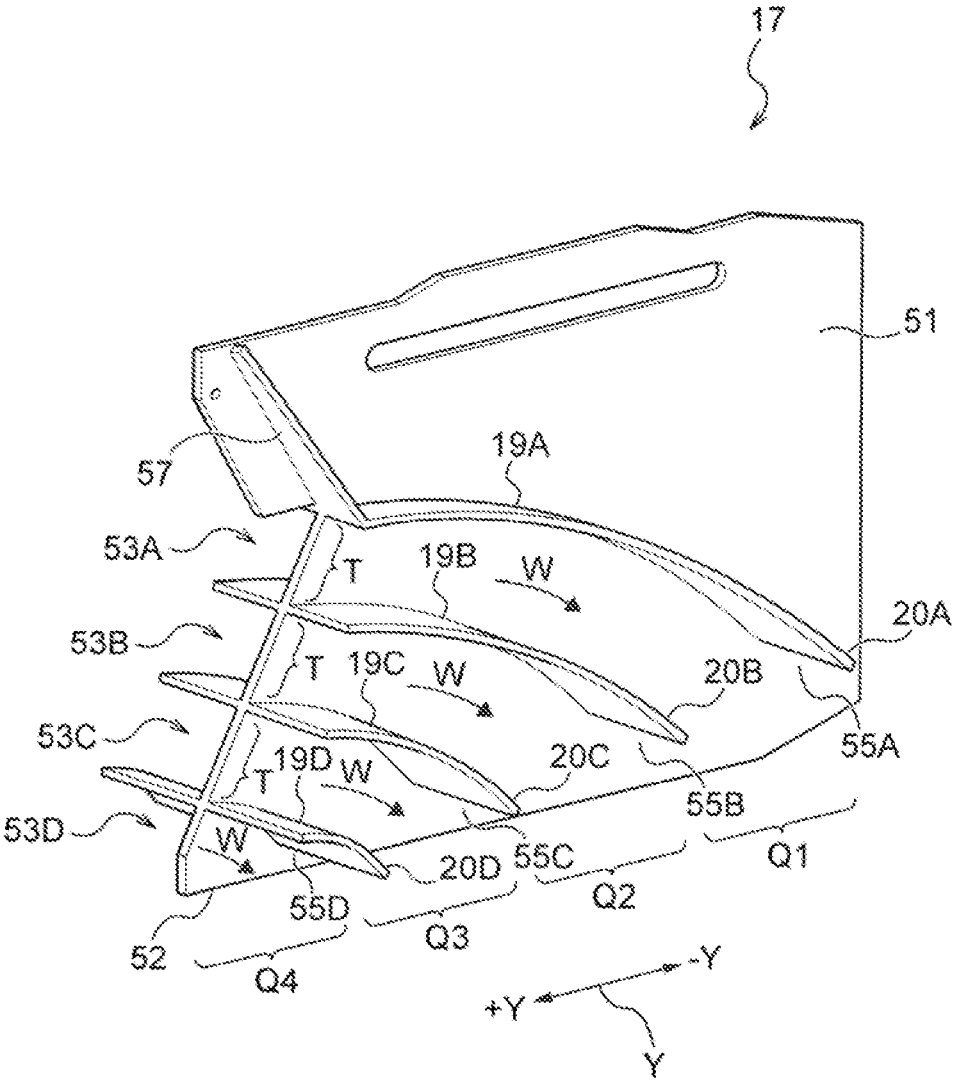
FIG. 4 is a perspective view illustrating a first air guiding member according to the embodiment of the present disclosure.

As illustrated in FIG. 4, the first air guide member 17 includes, for example, a base plate 51 having a substantially rectangular flat plate shape whose front positive Y side is recessed in a V-shape, and is formed by disposing the number a of the first guides 19, each having a curved flat plate shape, for example, in a plane-symmetrical manner on both left and right surfaces of the base plate 51.

In the embodiment illustrated in the drawings, four of the first guides 19 are provided. A first guide 19A of a first stage, which is positioned on the inner circumferential side when attached to the rotary drum 9 and positioned at the uppermost position in FIG. 4, is configured to be longest, and a position of a leading end portion 20A thereof is configured to be positioned rearmost toward the negative Y side.

Then, in FIG. 4, the first guides 19B, 19C, and 19D of a second stage, a third stage, and a fourth stage are disposed, one below the other, with substantially the same interval T therebetween, and positions of leading end portions 20B, 20C, and 20D are configured to be positioned gradually further to the front toward the positive Y side at each of the intervals T.

Further, width dimensions of the first guides 19A, 19B, 19C, and 19D of the first stage to the fourth stage are formed so as to correspond to the above-described fan-shape in a front view, namely, the width dimension of the first guide 19A of the first stage positioned on the innermost circumferential side is formed to be narrowest, and the width dimension of the first guide 19D of the fourth stage positioned on the outermost circumferential side is formed to be widest.

Then, four passageways 53A, 53B, 53C, and 53D of the cooling air W are formed between the four first guides 19A, 19B, 19C, and 19D and the inner surface 3*a* of the cylindrical body 3. Then, a configuration is adopted in which the cooling air W that has passed through the first passageway 53A positioned on the innermost circumferential side reaches a first region Q1 positioned rearmost on the negative Y side, and then sequentially, toward the outer circumferential side, each of the second passageway 53B, the third passageway 53C, and the fourth passageway 53D guides the cooling air W in this order to a second region Q2, a third region Q3, and a fourth region Q4 that are positioned further to the front toward the positive Y side.

Further, in relation to the four ribs 49, so that the positions of each of the leading end portions 20A, 20B, 20C, and 20D of the four first guides 19A, 19B, 19C, and 19D do not coincide with the positions of the ribs 49, the leading end portions 20A, 20B, 20C, and 20D are set to positions substantially displaced by half a pitch with respect to an arrangement pitch of the ribs 49, for example. As a result, a configuration is obtained in which progress of the air W, which has been supplied by the four first cooling fans 15A, 15B, 15C, and 15D and which has been blown against and caused to flow up by the ribs 49, is obstructed as a result of the air W hitting opposing wall surfaces of each of the first guides 19A, 19B, 19C, and 19D. Then, the air W is guided toward the inner surface 3*a* side of the cylindrical body 3 by the subsequent air W flowing through each of the passageways 53A, 53B, 53C, and 53D.

Further, as illustrated in FIG. 4, each of the leading end portions 20A, 20B, 20C, and 20D of each of the first guides 19A, 19B, 19C, and 19D does not reach a lower end edge 52 of the base plate 51, and intervals 55A, 55B, 55C, and 55D are formed between each of the leading end portions 20A, 20B, 20C, and 20D and the lower end edge 52.

Then, those intervals 55A, 55B, 55C, and 55D are set, for example, so that a relationship 55A>55B>55C>55D is established in which the interval 55A positioned rearmost toward the negative Y side is widest, and then, the intervals 55B, 55C, and 55D sequentially become narrower toward the front on the positive Y side.

Incidentally, by setting the intervals 55A, 55B, 55C, and 55D in this manner, a configuration is obtained in which the cooling air W that has reached the inner surface 3*a* of the cylindrical body 3 after passing through each of the passageways 53A, 53B, 53C, and 53D performs cooling of each of the corresponding regions Q1, Q2, Q3, and Q4, and at the same time, part of the cooling air W reaches the adjacent region Q through the intervals 55A, 55B, 55C and 55D, thereby also contributing to cooling of the adjacent region Q.

In addition, as illustrated in FIG. 4, so that the cooling air W does not flow into a space above the first guide 19A, a blocking cover 57 is formed at a front end portion of the first guide 19A, which is positioned closest to the inner circumference, so as to block the opening thereof.

Figure 5:
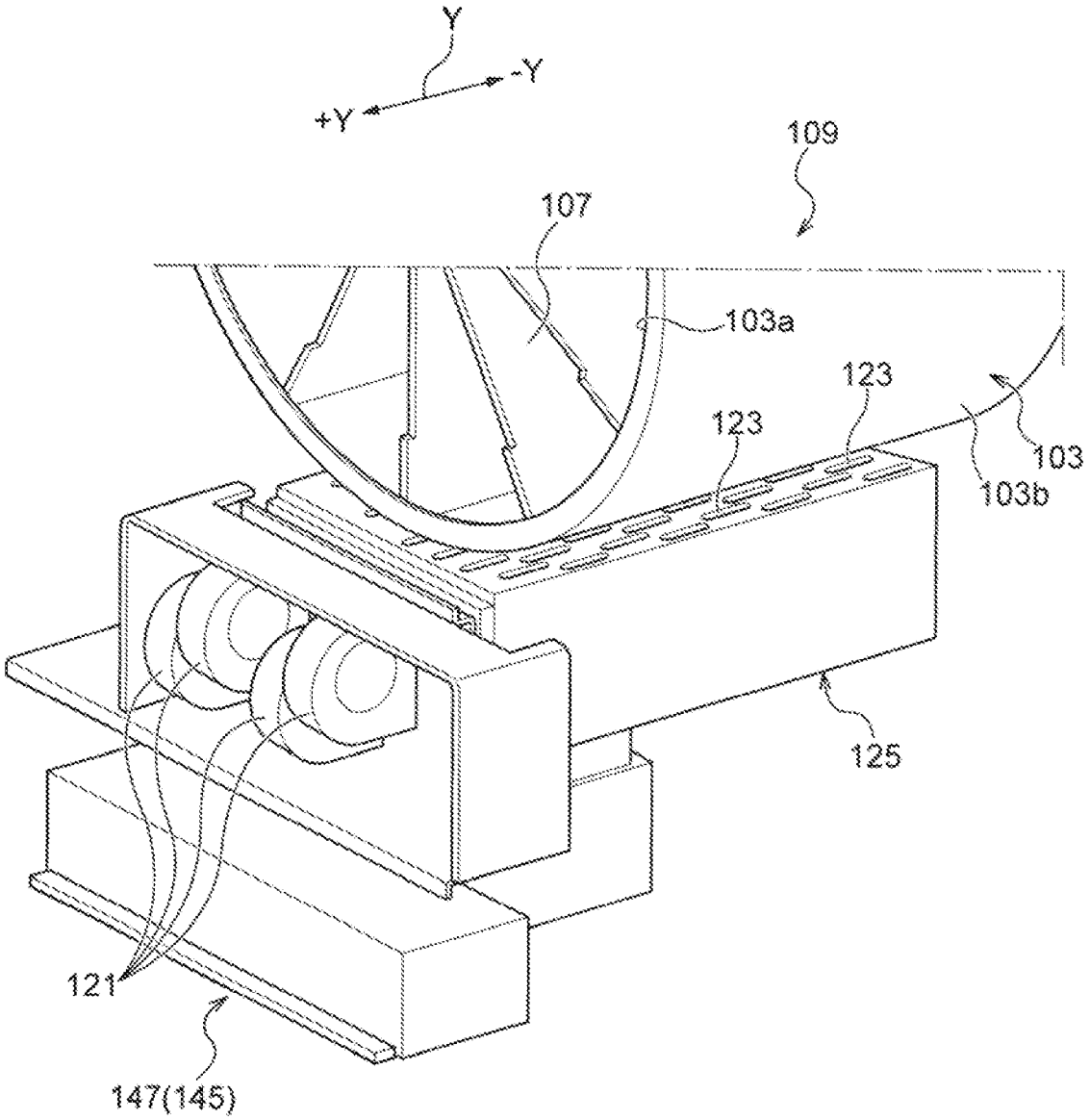
FIG. 5 is a perspective view illustrating a cooling unit provided at an outer surface of a rotary drum of related art.
Figure 6:
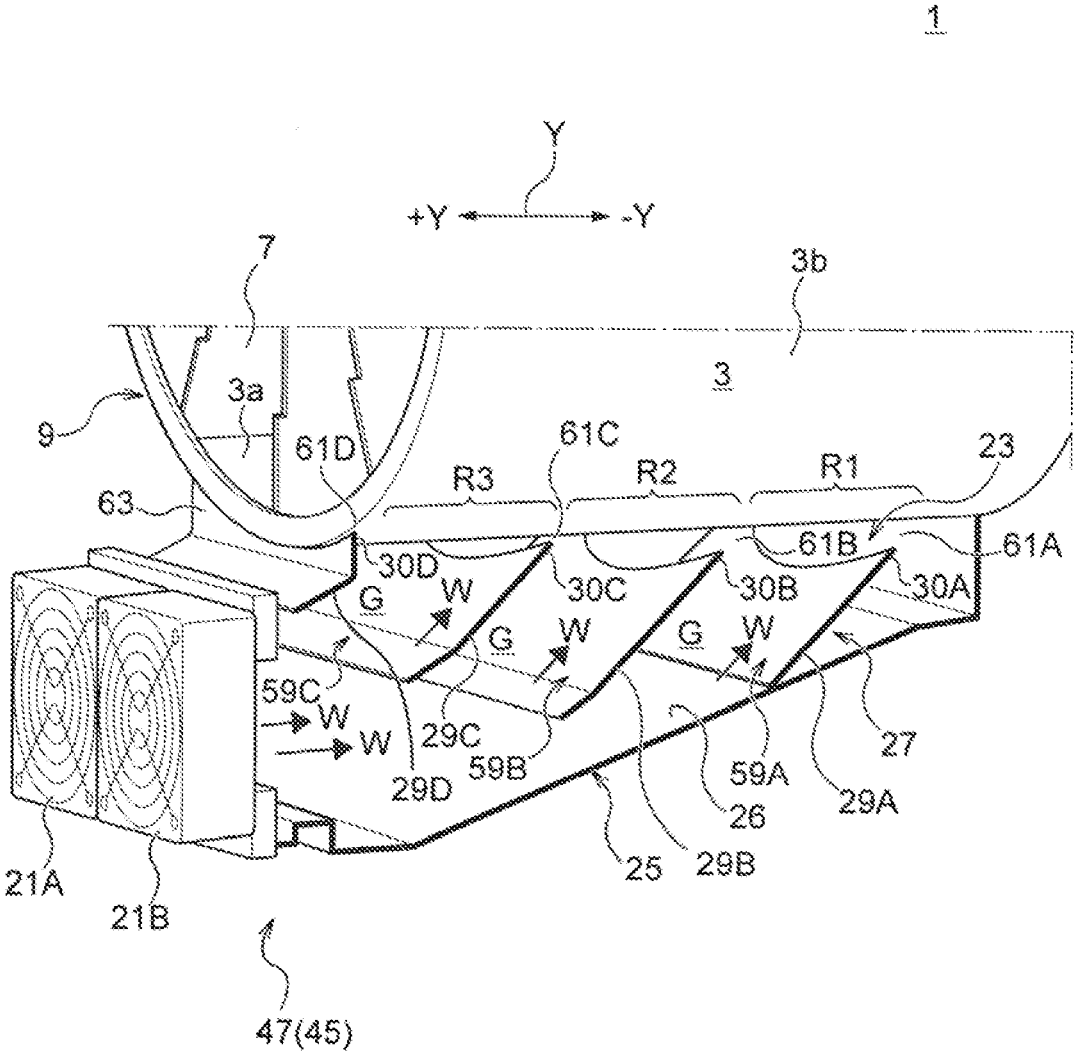
FIG. 6 is a perspective view illustrating the second cooling unit according to the embodiment of the present disclosure.

(B) Specific Configuration of Second Cooling Unit (See FIG. 5 and FIG. 6)

The second cooling unit 47 includes the second cooling fans 21, the air box 25 disposed in the non-winding area U of the rotary drum 9, and the second air guide member 27 provided in the air box 25.

Hereinafter, the configuration of the second cooling unit 47 according to this embodiment illustrated in FIG. 6 will be specifically described in comparison to a cooling unit 147 provided at an outer surface of a rotary drum of related art illustrated in FIG. 5.

As illustrated in FIG. 5, the cooling unit 147 provided at the outer surface of the rotary drum of the related art includes a plurality of sirocco fans 121, and a rectangular box-shaped air box 125 in an upper surface of which a large number of slits 123 are formed. Then, the smooth upper surface of the air box 125 in which the slits 123 are formed is disposed so as to face an outer surface 103*b* of a cylindrical body 103 of a rotary drum 109 in close proximity.

As a result, the cooling air W supplied into the air box 125 from the sirocco fans 121 is blown, through the slits 123 in the upper surface of the air box 125, against the outer surface 103*b* of the cylindrical body 103 of the rotary drum 109, thereby cooling the rotary drum 109 from the outer surface 103*b* side.

However, when the cooling unit 147 provided at the outer surface of the rotary drum having the above-described structure is employed, all of the cooling air W supplied into the air box 125 is not necessarily used for cooling the rotary drum 109, and part of the cooling air W simply circulates inside the air box 125 and is not directly used for cooling the rotary drum 109. Thus, there is a room for improvement in terms of cooling efficiency.

On the other hand, in the case of the second cooling unit 47 according to this embodiment, since the shape of the air box 25 is specially designed, and further, since the second air guide member 27 is disposed inside the air box 25, the cooling air W supplied into the air box 25 efficiently acts on the outer surface 3*b* of the cylindrical body 3 of the rotary drum 9 so as to be able to cool the rotary drum 9.

Specifically, a bottom surface 26 of the air box 25 is formed by a slope-like inclined surface that comes closer to the rotary drum 9 side as the bottom surface 26 extends further rearward toward the negative Y side. Further, an opening (not illustrated) for introducing the cooling air W supplied from the two second cooling fans 21A and 21B into the air box 25 is formed in a front surface of the air box 25. Further, an upper surface of the air box 25 is open, for example, and all of the upper surface serves as the air outlet 23.

Further, for example, the second air guide member 27 is configured by four of the second guides 29 that are inclined like a slope. Then, a second guide 29D of a fourth stage, which is closest to the rotary drum 9 and positioned at the uppermost position in FIG. 6, is shortest, and lengths of second guides 29C, 29B, and 29A of a third stage, a second stage, and a first stage are longer than that of the second guide 29D of the fourth stage and are formed to be substantially the same lengths, for example.

Further, mounting positions of the four second guides 29A, 29B, 29C, and 29D in the direction Y along the rotary shaft 5 are set such that the second guide 29D of the fourth stage, which is positioned at the uppermost position, is provided furthermost to the front on the positive Y side.

Then, the positions of the second guides 29C, 29B, and 29A of the third stage, the second stage, and the first stage are arranged so as to be positioned gradually further rearward toward the negative Y side. Intervals G between the four second guides 29A, 29B, 29C, and 29D are set to be substantially the same size, for example.

Further, three passageways 59A, 59B, and 59C of the cooling air W are formed between the four second guides 29A, 29B, 29C and 29D and the outer surface 3*b* of the cylindrical body 3. Then, a configuration is obtained in which the cooling air W that has passed through the third passageway 59C positioned closest to the rotary drum 9 reaches a third region R3 positioned most frontward on the positive Y side, and then sequentially, the second passageway 58B and the first passageway 59A guide the cooling air W to a second region R2 and a first region R1, respectively, which are positioned further rearward toward the negative Y side in this order.

Further, as illustrated in FIG. 6, respective leading end portions 30A, 30B, 30C, and 30D of each of the second guides 29A, 29B, 29C, and 29D is formed in a curved concave shape following the shape of the outer surface 3*b* of the cylindrical body 3 of the rotary drum 9, for example.

Further, intervals 61A, 61B, 61C, and 61D are formed between the leading end portions 30A, 30B, 30C, and 30D and the outer surface 3*b* of the cylindrical body 3 of the rotary drum 9. These intervals 61A, 61B, 61C, and 61D are set, for example, such that a relationship of 61A>61B>61C>61D is established in which the interval 61A positioned most rearward on the negative Y side is widest and the intervals 61B, 61C and 61D sequentially get narrower toward the front on the positive Y side.

Incidentally, by setting the intervals 61A, 61B, 61C, and 61D in this manner, a configuration is obtained in which the cooling air W that has reached the outer surface 3*b* of the cylindrical body 3 after passing through each of the passageways 59A, 59B, and 59C performs cooling of each of the corresponding regions R1, R2, and R3, and part of the cooling air W reaches the adjacent region R through the intervals 61A, 61B, and 61C, thereby also contributing to cooling of the adjacent region R.

In addition, a rear end portion of the second guide 29D of the fourth stage closest to the rotary drum 9 is formed so as to stand up toward the rotary drum 9 side, and functions as a blocking plate 63. The leading end portion 30D is formed on an end edge of the blocking plate 63 on the rotary drum 9 side. Note that the blocking plate 63 plays a role in preventing the cooling air W supplied through the passageway 59C from escaping from a gap on the front positive Y side toward the front positive Y side.

Figure 8:
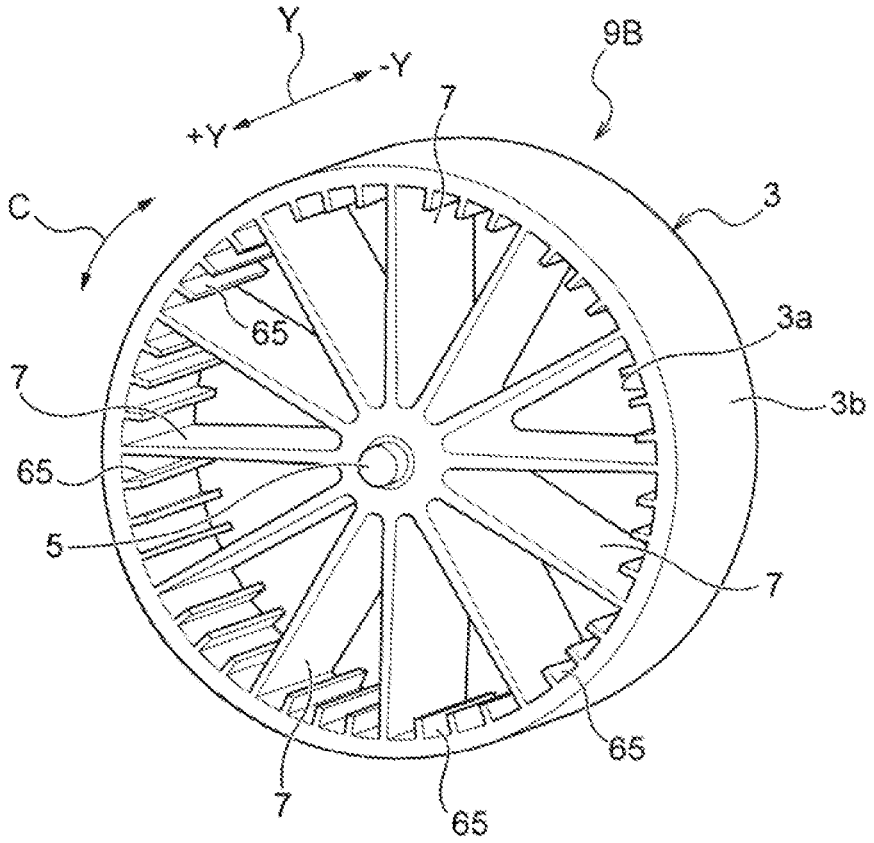
FIG. 8 is a perspective view illustrating a modified example of the rotary drum according to the embodiment of the present disclosure.

(3) Configuration of Modified Example of Rotary Drum (See FIG. 8)

Next, a modified example in which a plurality of cooling fins 65 are provided at the inner surface 3*a* of the cylindrical body 3 of the rotary drum 9 will be described.

Specifically, as illustrated in FIG. 8, it is also possible to employ a rotary drum 9B having a configuration in which the plurality of cooling fins 65 are provided, each of which has a predetermined height and extends radially from the inner surface 3*a* of the cylindrical body 3 toward the rotary shaft 5.

When the rotary drum 9B having such a configuration is employed, in addition to the cooling effect achieved by the cooling air W using the first cooling unit 46 and the second cooling unit 47, a heat dissipation effect by the cooling fins 65 is added, and the cooling efficiency can thus be further improved.

Figure 9:
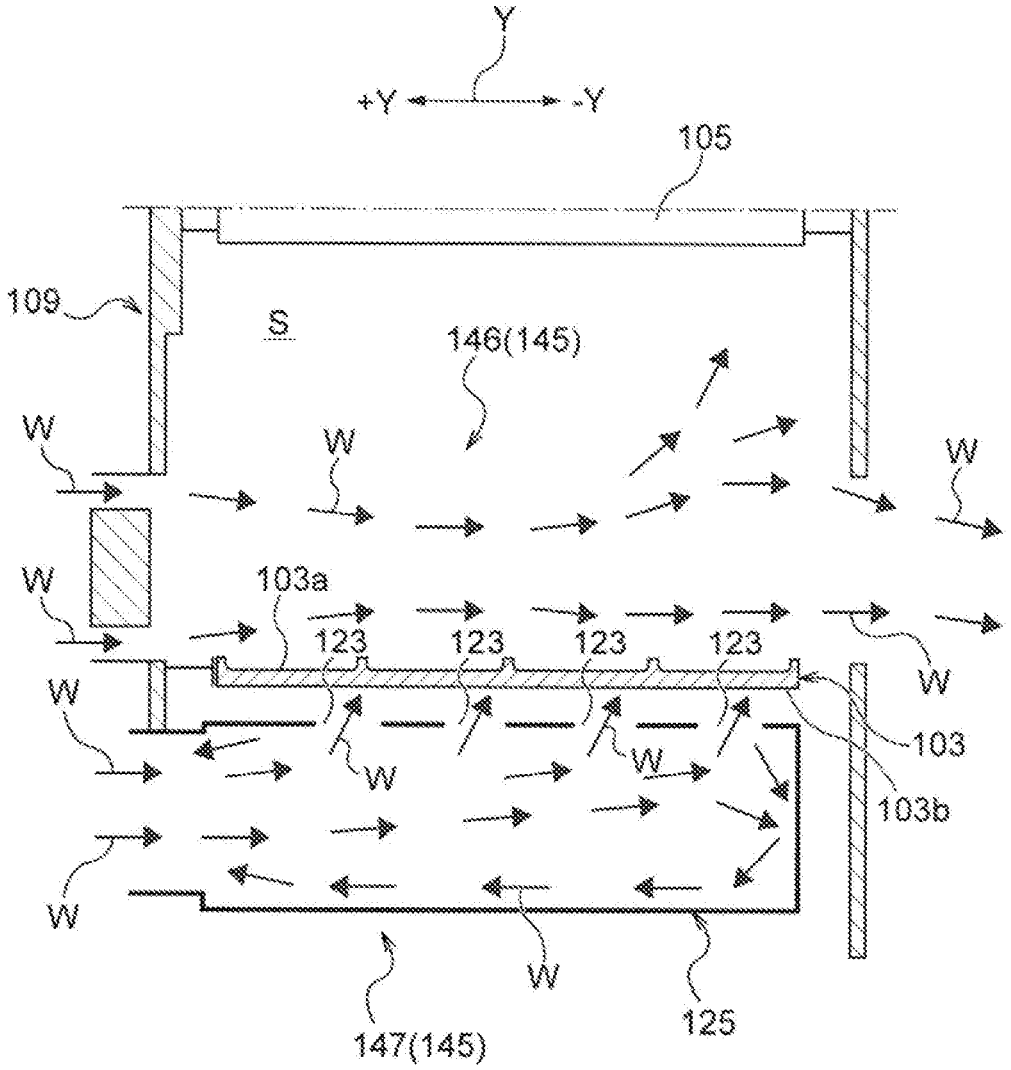
FIG. 9 is a side cross-sectional view illustrating a flow of cooling air when a cooling unit of the rotary drum of the related art is employed.
Figure 10:
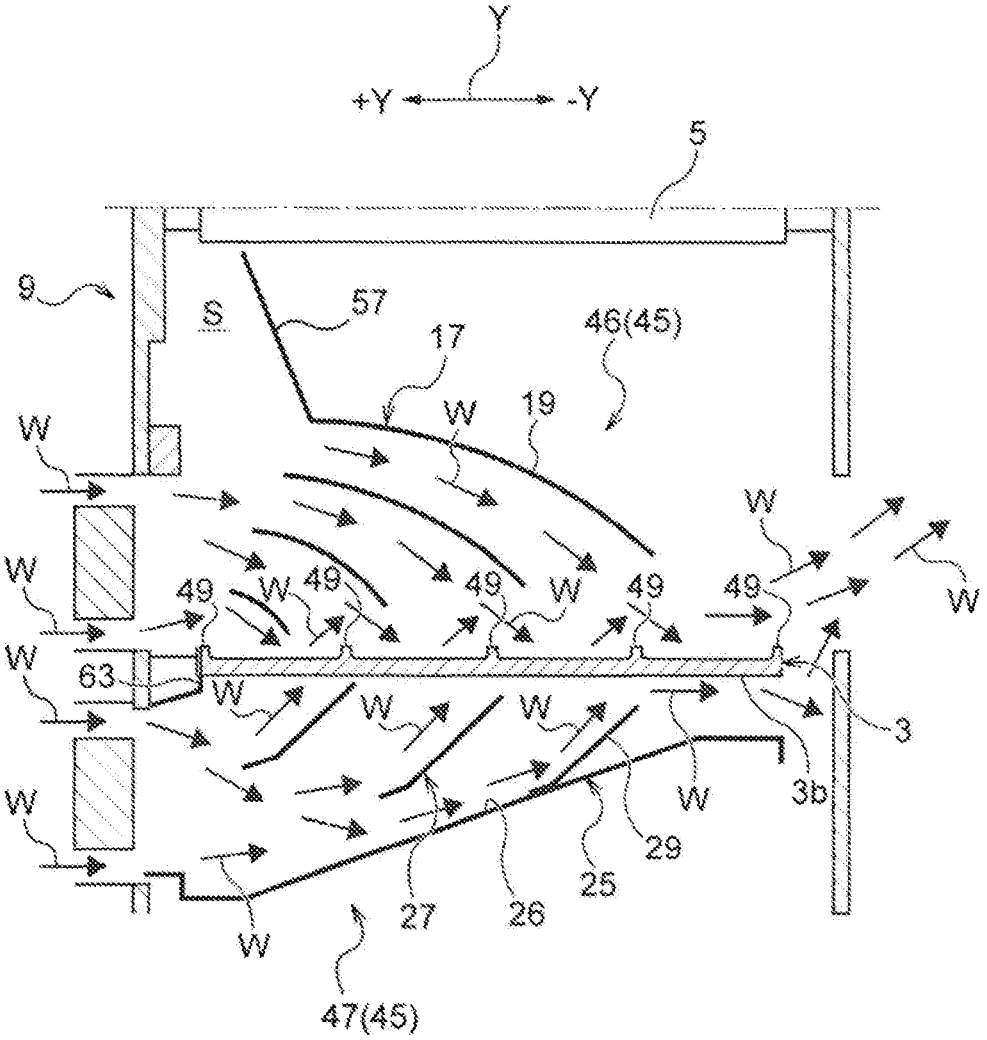
FIG. 10 is a side cross-sectional view illustrating the flow of the cooling air when the first cooling unit and the second cooling unit according to the embodiment of the present disclosure are employed.

(4) Comparative Test on Flow of Cooling Air (See FIG. 9 and FIG. 10)

Next, test results obtained when comparing a flow of the cooling air W when a cooling unit 145 of the rotary drum of the related art is employed with the flow of the cooling air W when the cooling unit 45 including the first cooling unit 46 and the second cooling unit 47 according to the embodiment of the present disclosure is employed will be described.

As illustrated in FIG. 9, when a cooling unit 146 of the related art is employed, most of the cooling air W introduced into the fan-shaped section in a front view blows through from the front on the positive Y side to the rear toward the negative Y side, almost without hitting the inner surface 103*a* of the cylindrical body 103 of the rotary drum 109.

Further, when the cooling unit 147 provided at the outer surface of the rotary drum of the related art is employed, the cooling air W is heated as a result of the cooling air W being circulated in the rectangular box-shaped air box 125, and the air W whose temperature has risen is blown out from the slits 123 and acts locally on the outer surface 103*b* of the cylindrical body 103 to cool the rotary drum 109.

In contrast, by employing the first cooling unit 46 in this embodiment, the fresh cooling air W is divided and efficiently blown against the inner surface 3*a* of the cylindrical body 3 in each of the regions Q1, Q2, Q3, and Q4. Thus, effective cooling of the rotary drum 9 from the inner surface 3*a* of the rotary drum 9 can be expected.

Further, an improvement is made in that the cooling air W that has been blown against and caused to flow up by the ribs 49 provided at the inner surface 3*a* of the cylindrical body 3 is also caused to flow once again toward the inner surface 3*a* side of the cylindrical body 3 by the subsequent fresh cooling air W flowing through each of the passageways 53A, 53B, 53C, and 53D.

Further, in this embodiment, by employing the second cooling unit 47, similarly to the case in which the first cooling unit 46 is employed, the fresh cooling air W is divided and efficiently blown against the outer surface 3*b* of the cylindrical body 3 in each of the regions R1, R2, and R3. Thus, efficient cooling of the rotary drum 9 from the outer surface 3*b* of the rotary drum 9 can be expected.

Then, according to the printing apparatus 1 of this embodiment configured in this manner, since the rotary drum 9 that functions as a platen drum supporting the recording medium P can be efficiently cooled, an increase in the temperature of the rotary drum 9 can be suppressed. Further, as a result, it is possible to suppress an increase in the temperature of the rotary drum 9 due to heat generated when the UV ink ejected onto the recording medium P is cured, and to reduce irregularity of the printing quality as a result of changes in the amount of ink ejected from the ejecting head 11, which are caused by changes in the ink viscosity due to overheating of the ink in the ejecting head 11 by radiant heat from the rotary drum 9. Thus, a good quality of an image printed on the recording medium P can be maintained.

Further, in addition to the combined use of the first cooling unit 46 acting on the inner surface 3*a* of the rotary drum 9 and the second cooling unit 47 acting on the outer surface 3*b* of the rotary drum 9, the structure of the first air guide member 17 itself and of the second air guide member 27 itself can efficiently perform the cooling of the rotary drum 9. Thus, it is also possible to reduce the overall cost of the printing apparatus 1 by minimizing the number of the first cooling fans 15 and the second cooling fans 21 and reducing the noise of the cooling fans 15 and 21 by using the cooling air W at a low airflow rate.

Other Exemplary Embodiments

Examples of the printing apparatus 1 according to the present disclosure are basically configured as described above, but it is of course possible to change or omit a partial configuration within a range that does not depart from the gist of the present disclosure of the present application.

For example, the number of the first cooling fans 15 and the second cooling fans 21 and the number of the first guides 19 and the second guides 29 are not limited to the numbers described in the above-described embodiment, and each may be a number smaller or greater than that described in the embodiment. Further, the first cooling fan 15 and the second cooling fan 21 can be configured by a single cooling fan and configured to supply the cooling air W to a plurality of target positions via a duct, an air hose, or the like.

Further, the first air guide member 17 can be formed from a material that has good thermal conductivity such as aluminum or copper, and a portion of the first air guide member 17 can be in contact with the inner surface 3*a* of the rotary drum 9, an outer surface of the rotary shaft 5, the arm portion 7, or the like to further improve the cooling effect.

Further, the first air guide member 17 is not limited to the configuration in which the first guides 19 are provided in a plane-symmetrical manner on the left and right sides of the base plate 51 so as to sandwich the base plate 51, and a formation angle, shape, number, interval, length, and the like of the first guides 19 can also be changed on the left and right sides of the base plate 51. Further, although the cooling effect is reduced, the first guides 19 can also be provided on only one of the sides of the base plate 51.

Further, when the plurality of first guides 19 can be assembled to the fan-shaped section in a front view without the base plate 51, the first guide member 17 formed by only the first guides 19 without including the base plate 51 can also be used.

In addition, the upper surface of the air box 25 in the second cooling unit 47 is open in the above-described embodiment, and the whole surface is used as the air outlet 23. However, the air box 25 having a configuration in which the upper surface of the air box 25 is closed by a lid, which is provided with a large number of holes, slits or the like and has a shape following the outer surface 3*b* of the cylindrical body 3, can also be used.

Further, the first cooling unit 46 and the second cooling unit 47 of the present disclosure can be used not only for cooling the rotary drum 9, but also for cooling other heating units while utilizing part of the cooling air W thereof. Further, the first cooling unit 46 and the second cooling unit 47 of the present disclosure are not limited to being applied to a printing apparatus that uses UV ink, but also can be applied to a printing apparatus that uses thermosetting ink. Further, the printing apparatus 1 including only the first cooling unit 46 can also be employed.

What is claimed is:

1. A printing apparatus comprising:

a rotary drum including a cylindrical body, a rotary shaft, and a plurality of arm portions that couple an inner surface of the cylindrical body with the rotary shaft and are provided at an interval in a circumferential direction of the cylindrical body;

an ejecting unit configured to eject liquid to perform printing on a recording medium that is transported while being wound around the cylindrical body of the rotary drum;

a first cooling fan configured to supply air into a passageway of the air in a direction along the rotary shaft, the passageway of the air being a section inside the rotary drum corresponding to the interval between the plurality of arm portions; and a first air guide member retrofitted to the passageway of the air between the plurality of arm portions, wherein the first air guide member is provided with a first guides, a being an integer of no less than 2, and the a first guides guide the air from the first cooling fan to different positions on the inner surface of the cylindrical body, the different positions being, when the inner surface of the cylindrical body is divided into a regions in the direction along the rotary shaft, each of the a divided regions.

2. The printing apparatus according to claim 1, wherein a unit volume weight of a material of the first air guide member is lighter than a unit volume weight of a material of the rotary drum.

3. The printing apparatus according to claim 1, wherein a plurality of ribs formed in the circumferential direction are provided at the inner surface of the cylindrical body, the plurality of ribs are disposed at an interval in the direction along the rotary shaft, and the different positions to which the air is guided by the a first guides are positions where the air, supplied from the first cooling fan to hit the plurality of ribs and flow up, is guided toward the inner surface of the cylindrical body.

4. The printing apparatus according to claim 1, wherein the first air guide member is provided with a base plate and the a first guides disposed on the base plate, and the a first guides are disposed, on both sides of the base plate, plane symmetrically.

5. The printing apparatus according to claim 1, comprising:

a second cooling fan configured to supply the air along an outer surface of the cylindrical body in the direction along the rotary shaft;

an air box configured to receive the air supplied from the second cooling fan and provided with an air outlet through which the air is blown toward the outer surface of the cylindrical body; and a second air guide member provided in the air box, wherein the second air guide member is provided with b second guides, b being an integer of no less than 3, and the b second guides guide the air from the second cooling fan to different positions of the air outlet, the different positions being, when the outer surface of the cylindrical body is divided into b−1 regions in the direction along the rotary shaft, the b−1 divided regions respectively.

* * * * *